United States Patent [19]

Lovisa et al.

[11] 4,052,032

[45] * Oct. 4, 1977

[54] EXTERIOR FORM SPREADER SYSTEM FOR THREADED END CONCRETE TIES

[76] Inventors: Peter R. Lovisa, 1040 Pelhamdale Ave., Pelham Manor, N.Y. 10803; Dusan Tausanovitch, 24 Crestwood Drive, Northport, N.Y. 11768; Tullio E. Lovisa, 91 Whitson Road, Huntington, L.I., N.Y. 11743

[ * ] Notice: The portion of the term of this patent subsequent to Sept. 2, 1992, has been disclaimed.

[21] Appl. No.: 629,369

[22] Filed: Nov. 6, 1975

Related U.S. Application Data

[62] Division of Ser. No. 525,887, Nov. 21, 1974, Pat. No. 3,920,214.

[51] Int. Cl.[2] ..... F04E 11/06; F04E 17/06; F16B 37/00

[52] U.S. Cl. ..... 249/40; 85/32 W; 85/32 K

[58] Field of Search ..... 249/40, 213, 216, 217, 249/42, 45, 46, 47, 190, 191; 254/67; 85/32 W, 32 K

[56] References Cited

U.S. PATENT DOCUMENTS

| | | | |
|---|---|---|---|
| 546,903 | 9/1895 | Ryan | 85/32 W |
| 1,938,153 | 12/1933 | Reeves | 249/217 |
| 2,172,461 | 9/1939 | Whitescarver | 249/213 X |
| 2,270,448 | 1/1942 | Juhl | 249/213 X |
| 3,128,524 | 4/1964 | Kay | 249/217 |
| 3,141,224 | 7/1964 | Gates | 249/217 X |
| 3,236,490 | 2/1966 | Lovgren | 249/45 |
| 3,263,958 | 8/1966 | Cox et al. | 249/213 |
| 3,292,893 | 12/1966 | Williams | 249/191 X |
| 3,822,860 | 7/1974 | Lovisa | 249/217 |
| 3,880,397 | 4/1975 | Becker | 249/46 X |

FOREIGN PATENT DOCUMENTS

| | | | |
|---|---|---|---|
| 570,438 | 1/1924 | France | 85/32 W |

*Primary Examiner*—Francis S. Husar
*Assistant Examiner*—John S. Brown
*Attorney, Agent, or Firm*—Kane, Dalsimer, Kane, Sullivan and Kurucz

[57] ABSTRACT

An externally controlled spreader system is designed for the adjustment of forms in both lateral directions, and is capable of being remotely activated as the forming operations require. This system is advantageously built into existing tie holding devices and includes a nut having a continuous circular notch on its exterior surface with an elongated member having a slotted hole adapted to be slideably connected to a conventional plate-washer. The slotted hole on the slideable member is modified in shape to engage or disengage the continuous notch on the nut, respectively, and consequently conform it to the position of the slideable member, without restricting its rotation. During threading, the nut exerts a force on the plate-washer assembly, which is adequately connected to the forms, and thus moves the forms laterally in the desired direction, while maintaining them constantly at any predetermined distance apart through the rigid tie rod.

5 Claims, 13 Drawing Figures

EXTERIOR FORM SPREADER SYSTEM FOR THREADED END CONCRETE TIES

This is a division of application Ser. No. 525,887, filed Nov. 21, 1974 now U.S. Pat. No. 3,920,214.

BACKGROUND OF THE INVENTION

Spreader action in concrete form ties is important and is required in order to keep both adjacent forms a specified distance apart during the concrete pour and also to assure integrity of design, uniform thickness and planar surfaces of the poured concrete wall. In addition, during the pour the upper part of the forms has a tendency to close and reduce wall dimensions at the top, because of the relatively heavy pressures of the poured concrete at the bottom. Thus, the spreader action of ties has to overcome this problem.

The normally employed spreader systems of conventional ties depend heavily on the rigidity of tie rods themselves. These rods have at each end projected swedging or similar provisions to support and maintain washers or cones inside of forms exactly at the face of the contemplated concrete wall. Consequently, washers or cones, larger than holes in the plywood, engage the inner face of the plywood and usually other members are designed to transfer compressive forces of exterior tie holding devices to the tie rods. Ties of this type require stripping of forms first and then removal of cones or perhaps break of the tie ends with washers after the forms are removed.

In the case of the commonly known pull-out-ties and tapered ties the rods are inserted through both erected forms, through the holes in the plywood of minimum required size to both permit entry of the rods and prevents excessive leakage of concrete grout. After concrete pour, the ties are removed before stripping of the forms. This procedure in closing and stripping forms is very beneficial and results in substantial labor savings in forming operations. It is also extremely conducive to the relatively new and economical large panel or gang forming operations normally handled by cranes. It is preferred, however, that the employed ties not have any built-in internal spreader system utilizing either projected washers or cones, which otherwise would be difficult if not impossible to insert through both forms in place, or to remove them from the concrete.

Some of the commercially available ties have notches on the external part of tie rods for special brackets engageable with outer form members (walers). However, an external spreader system of this type is not fully effective and practical, because it consists of many loose parts and is rather time consuming in execution. In addition, effective adjustment is limited to an inward direction only. If the forms are initially placed closer than the required distance or part of a form is leaning inwardly, existing exterior spreader systems simply cannot be used. These forms would then have to be reset or pulled out by hand, involving more work and costly crane time. There are a number of concrete construction personnel that still depend on the old fashioned deployment of pieces of wood between forms to be gradually removed as pour of concrete progresses.

To date, a fully effective, practical and economical spreader system is not in existence for the above group of ties with threaded ends which are inserted through both forms while in place, and after the ties are removed from the concrete both forms are free for stripping.

These ties with threaded ends are advantageous because they are the fastest and the most economical for gang forming. Also, completely removable ties of this type eliminate any possibility of rust marks. They are used more and more, especially with the growing volume of architectural concrete where it would be more convenient for better patching and matching of the concrete color and texture.

SUMMARY OF THE INVENTION

The principal object of the present invention is to provide a novel spreader system for removable concrete form ties having threaded ends, and which provides a simple but effective controlled adjustment of forms in both directions thereby eliminating costly and time consuming work.

Another object of the invention is to have a spreader system capable of adjusting and maintaining the forms at essentially any desire distance apart over a predetermined range of adjustment for the same tie to accommodate different wall sizes.

According to the invention herein, an externally controlled adjustment is provided for the form distance and is achieved by a releasable connection between the slideable part of a plate-washer assembly and a nut, which during the threading operation exerts the force on the plate-washer assembly, which is securely attached to the forms, and consequently moves and maintains the forms at the desired distance apart from one another.

BRIEF DESCRIPTION OF THE DRAWINGS

In the drawings:

FIG. 7*b* is an enlarged fragmentary side elevational view showing the attachment of the plate washer of FIG. 7*a.

DETAILED DESCRIPTION

Figure 1:
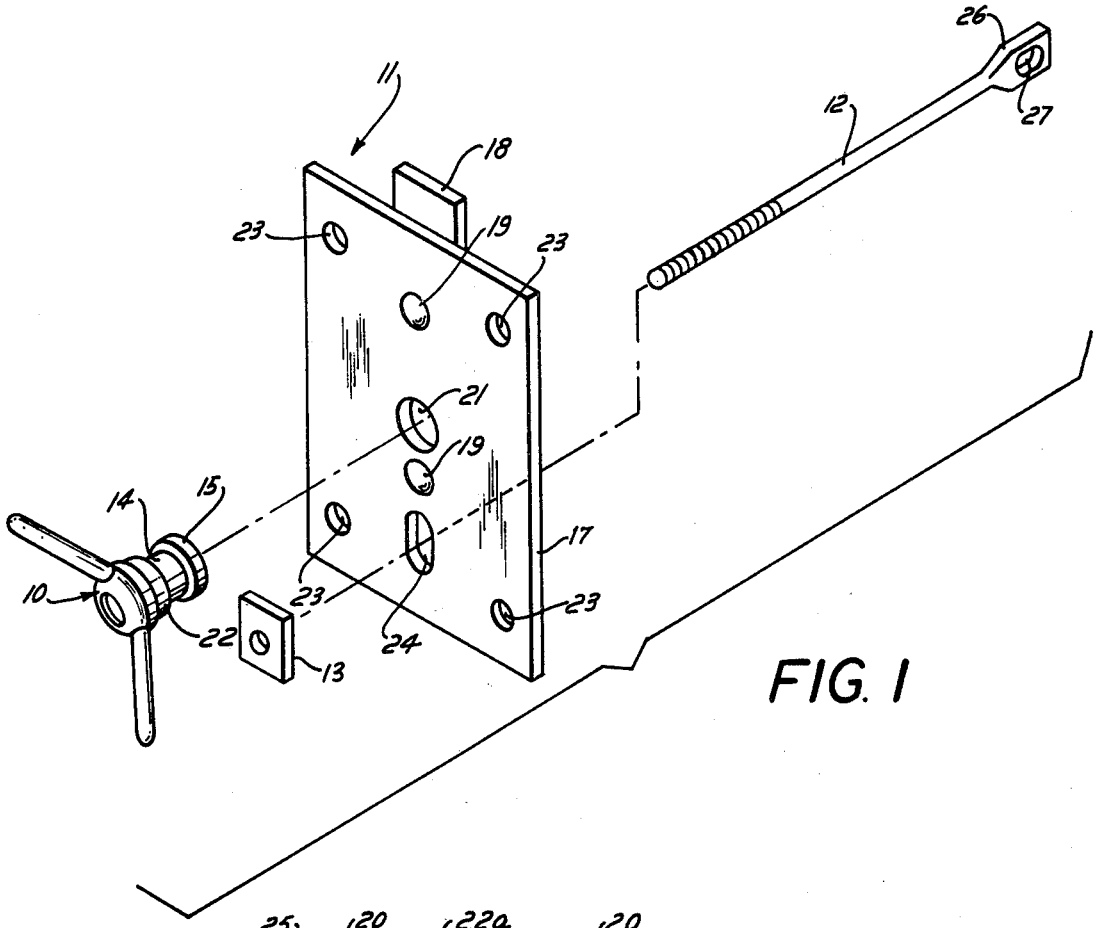
FIG. 1 is an exploded view of the improved concrete form spreader system.
Figure 2D:
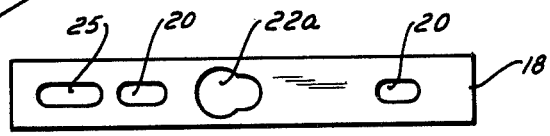
FIG. 2*d* is a plan view of the sliding member of the plate-washer assembly.
Figure 2A:
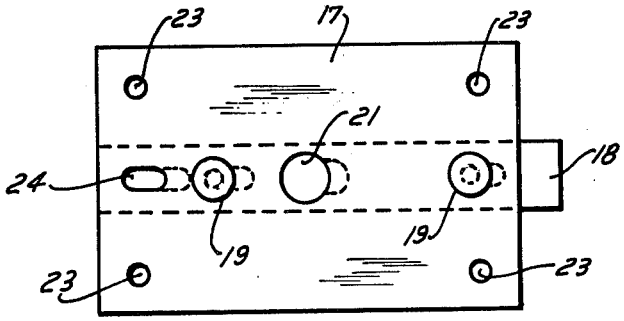
FIG. 2*a* is a plan elevational view of the plate-washer assembly.
Figure 2C:
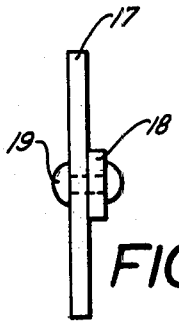
FIG. 2*c* is an end view of the plate-washer assembly.
Figure 2B:
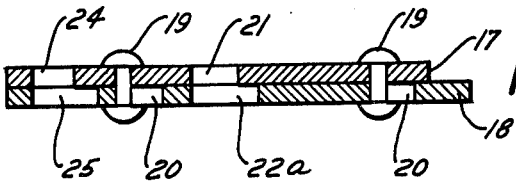
FIG. 2*b* is a longitudinal section of the plate-washer assembly.

The form spreader system of the present invention shown in FIG. 1 includes a nut 10, plate-washer assembly 11 and waler holder 12, equipped with a corresponding nut 13. Nut 10 has a continuous circular notch 14, radially projected bottom flange 15 and larger upper portion providing adequate bearing area 16. Plate-washer assembly 11, also shown separately in FIGS. 2*a*, *b*, *c*, and *d* consists of a plate-washer 17 and an elongated member 18 slidably connected to the plate-washer 17, by means of two rivets 19 disposed in two slotted holes 20 located in the member 18. Part of the rivets 19 which are embedded in the plate 17 may be of a slightly smaller diameter, forming a shoulder like area in order to create a small gap between part 17 and part 18 to thereby avoid possible friction between these parts. Circular hole 21 in the center of plate 17 is of size to allow insertion of projected portions 15 and 22 of nut 10 (see FIGS. 3 and 4), cylindrical portion 22 serving as a guide in centering the nut 10 in the washer-plate assembly 11. Projected bottom ring 15 provides the connection between nut 10 and slidable member 18 without restricting rotation threading of the nut 10. Elongated hole 22*a* located in the slidable member 18 is modified in shape to engage or disengage flange 15 depending on the relative position of the slidable member 18. The length of continuous notch 14 is slightly larger than the thickness of slidable member 18 in order to avoid any friction between member 18 and the nut 10 during the releasing operation after the concrete has been poured.

Figure 4:
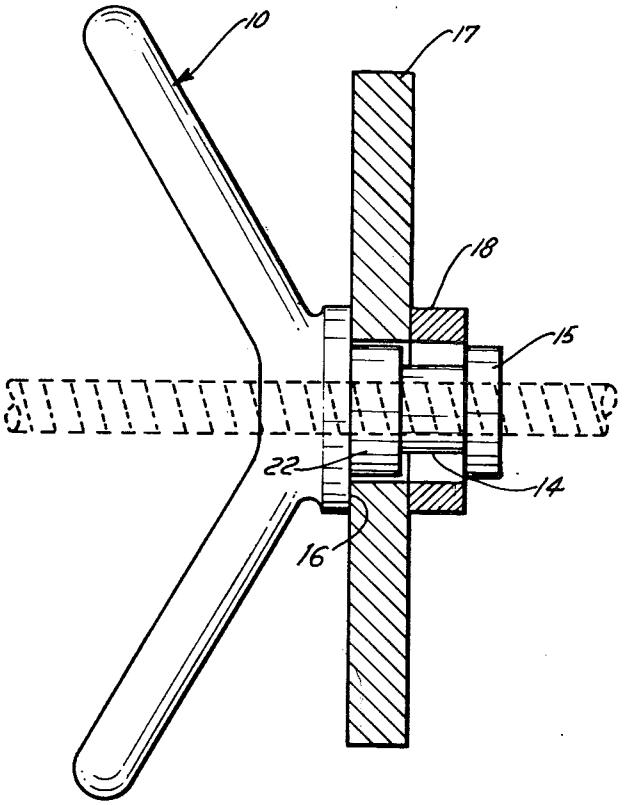
FIG. 4 is a similar view showing the sliding member releasing the nut.
Figure 3:
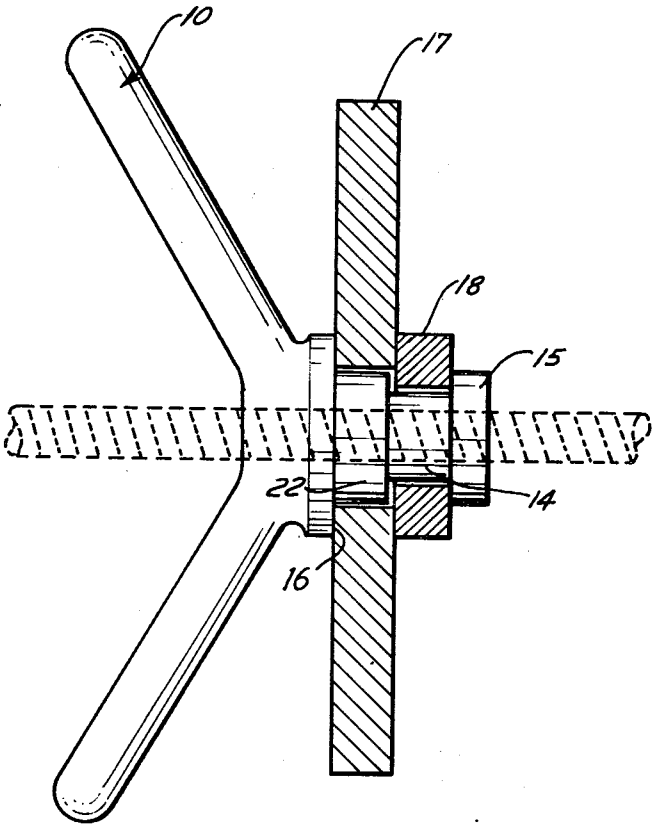
FIG. 3 is an elevational view partly in section showing the sliding member engaging the nut.
Figure 7A:
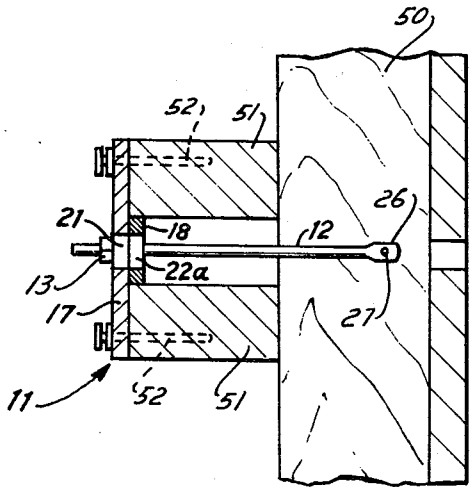
FIG. 7*a* is an enlarged fragmentary end elevational view partly in section illustrating means for attachment of the plate-washer to the forms.
Figure 7B:
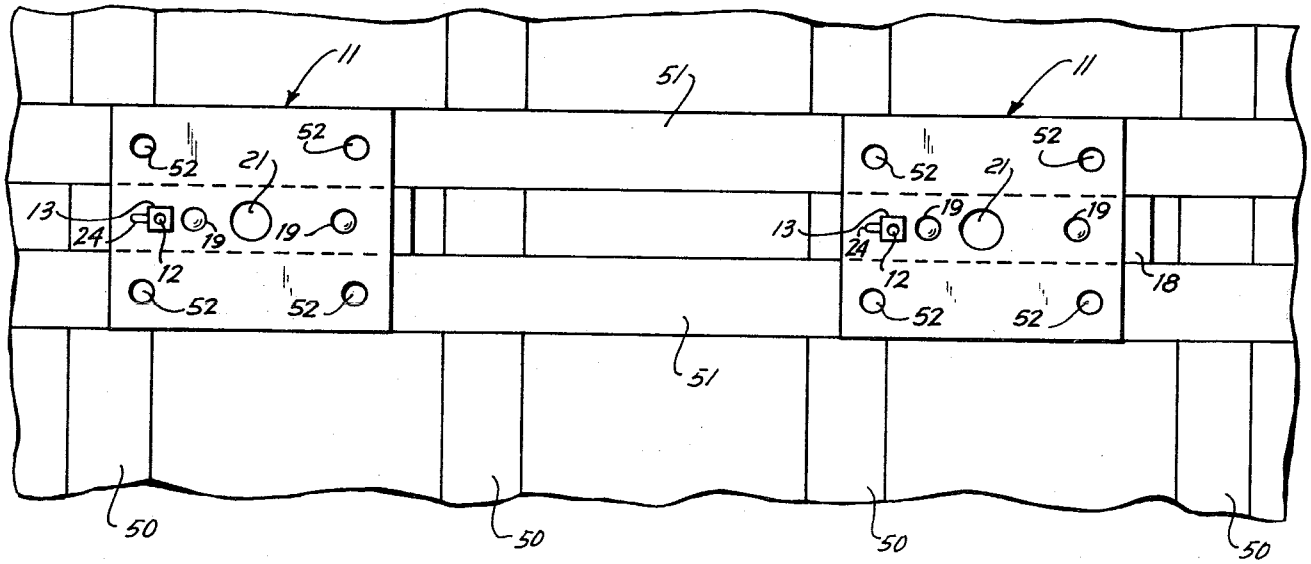

Concrete compressive forces will push the forms with plate assembly 11 towards the nut 10 (as shown in FIGS. 3 and 4), creating sufficient clearance for the slideable member 18 to be freely moved to the disengaged position. Holes 23 in the corners of plate-washer 17 are provided for nails to secure plate-washer assembly to the forms. Slot 24 in the plate-washer 17 and corresponding elongated slot 25 on the slideable member 18 are provided for the waler holder 12 to be installed as required, without restricting movement of slideable member 18. Waler holder 12 is threaded for connection with nut 13; opposite end 26 is flattened and formed with hole 27 for nailing or bolting to the stud 50 as shown in FIG. 7. Waler holder 12 is installed in the several required locations primarily to keep walers 51 in position. Nails 52 driven through the holes 23 on plate-washer 17 are sufficient to secure a permanent connection between the forms and plate-washer assembly 11.

Figure 5:
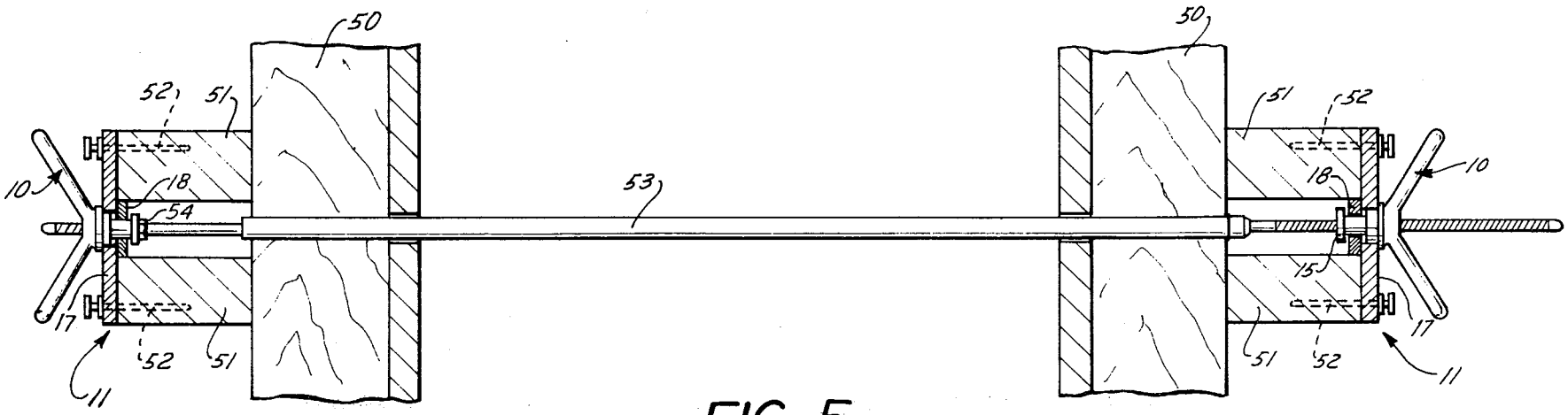
FIG. 5 is an elevational view partly in section of the spreader system applied to a contemplated embodiment of removable tie mounted in an elastic sleeve.

In FIG. 5 the spreader system of this invention is applied to one type of commercial removable tie 53, possessing a tie rod and elastic sleeve. In this embodiment nut 10 of FIG. 5 will exert force on the plate-washer assembly 11 through the slideable member 18. Consequently, the forms move out or in, depending on the direction of turning or threading keeping the forms in any desired position by the means of the connection between the spreader system and the tie 53 to withstand compressive or tensile forces applied to the forms.

Figure 6:
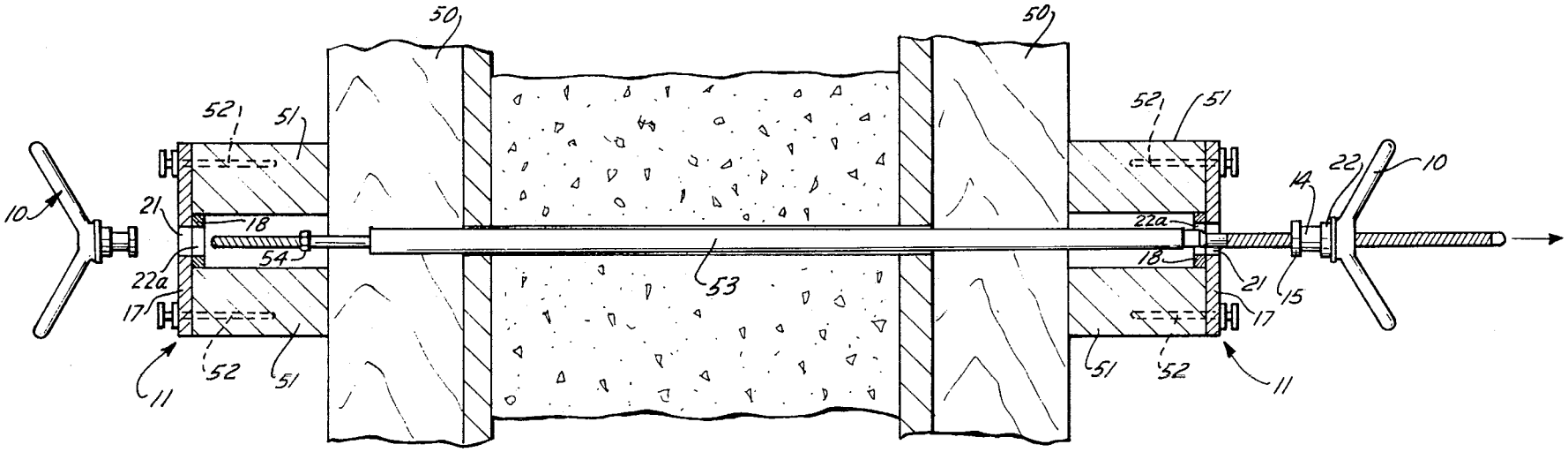
FIG. 6 is a similar elevational view showing the spreader system in a disengaged position with the tie ready to be withdrawn.

FIG. 6 shows the spreader system with slideable member 18 in its disengaged position, creating no interference to the tie 53 to be completely removed through the hole 21 located on the plate 17. It is evident that adjustment and spreading of the forms is achieved in a simple and effective way without any loose parts forming part of the spreader system. In comparison with conventional exterior spreader systems, which provide fixed distances between forms, the spreader system of this invention offers a continuous range of adjustment for the same tie used in different wall sizes. Positive control of a such adjustment is provided by measuring the lengths of the threaded tie rod ends that are projected beyond the nuts. As a simplification of the adjustment, the tie may be equipped on one threaded end, with swedgings 54 (on left side of FIG. 5) which will automatically stop and locate nut 10 in a fixed position, leaving only one opposite long threaded tie end for required adjustment by the same means of measuring tie end length projected beyond nut 10. Bearing in mind that usually one side of the forms is set first and braced in the selected proper position, this simplified arrangement advantageously contemplates the longer threaded tie end being installed only on the closing forms which under these circumstances is conveniently adjustable.

Figure 8A:
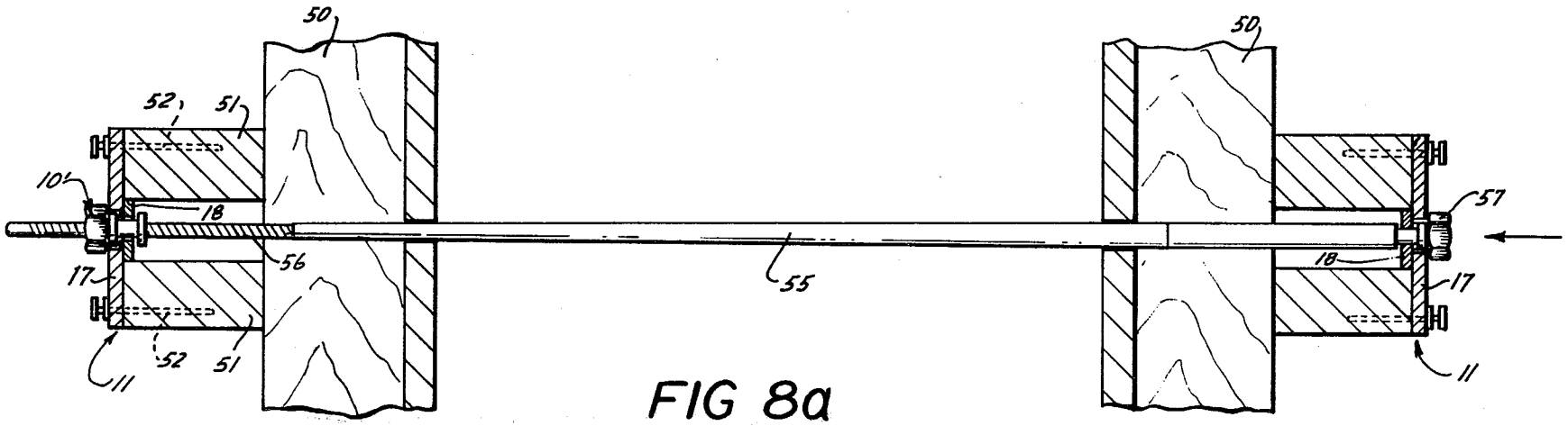
* and FIGS. 8*a* and 8*b* are enlarged fragmentary and elevational views partly in section of the spreader system applied to another form of tie known in the trade as tapered ties.
Figure 8B:
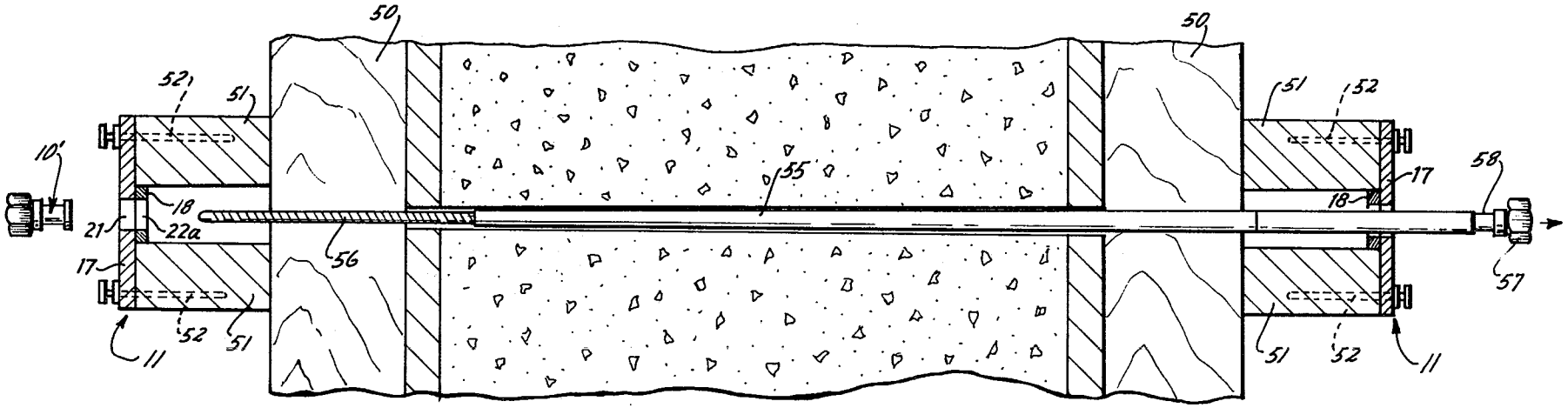

FIGS. 8*a* and 8*b* illustrates an application of the new spreader system of this invention to another type of tie known commercially as a tapered tie. Basically the same principle of spreader system is used with a simplified adjustment on one side only. Tapered ties 55 have a thread 56 on one end only for connection with nut 10′ which is releasably connected to plate-washer assembly 11. On the opposite end, loose nut 10′ is eliminated and substituted with permanent head 57 and notch 58 since there is no need for the thread and adjustment on this end. Therefore, this end may be located at the closing form side. Notch 58 corresponds to the notch 14 on the nut 10′ and may be engaged or disengaged with plate-washer assembly 11 by means similar to slidable member 18. It should be obvious that tapered tie 55 may have both ends threaded as with the embodiment of FIG. 5 and FIG. 6. Alternatively, tie 53 of the previous embodiment may have a similar form of spreader arrangement as that in FIG. 8*a* and 8*b*.

From the foregoing description, it will be seen that the present invention provides an improved, simple and economical exterior spreader system with easily achieved adjustment of forms in both directions and with elimination of all loose parts common to conventional spreader systems.

As variations may be made in the form, construction and arrangement of the parts herein, without departing from the spirit and scope of the invention, it is to be understood that all matters are to be interpreted as illustrative and not in any limiting sense.

We claim:

1. In a concrete form system including spaced wall forms and a tie rod having threaded ends cooperating with said forms, the combination of a. nut means internally threaded for engagement with the adjacent end of said tie rod, b. said nut means having a groove in the side thereof providing a pair of spaced opposed circumferential shoulders, c. a plate washer assembly including a plate having a through hole receiving the axially inner of said shoulders therethrough, d. means securing said plate assembly to the exterior of one of said forms with the end of said tie rod projecting through said hole, e. said nut means being threaded on said tie rod to a position wherein said inner shoulder thereon projects through said hole, f. and said assembly including means movable thereon with respect to said through hole into releasable engagement within said groove establishing a driving relation between said shoulders and said assembly, g. whereby threaded movement of said nut means on a tie rod will be transmitted through one of said shoulders and said assembly to cause movement of said form axially of said tie rod.

2. An exterior spreader system for a threaded end tie rod to provide for controlled adjustment of concrete forms in both direction lengthwise of the tie rod, comprising, a. nut means internally threaded for engagement with the adjacent end of the tie rod, b. said nut means having a groove in the side thereof providing a pair of spaced opposed circumferential shoulders, c. a plate washer assembly adapted to be secured to a form and including a plate having a through hole receiving the axially inner of said shoulders therethrough, d. said assembly including means movable thereon with respect to said through hole and releasably coupled with said nut means by engagement within said groove establishing a driving relation between said shoulders and said assembly, and e. whereby threaded movement of said nut means on the tie rod will be transmitted through one of said shoulders and said assembly to the form to which said plate is secured.

3. A system as defined in claim 2, wherein said movable means comprises a member mounted on said plate for movement thereon in substantially coplanar relation therewith and having therein a slot sized for reception in said groove with opposed sides thereof in interfitting relation with said shoulders.

4. A plate-washer assembly and nut means having a circumferential groove bounded by spaced opposed circumferential shoulders forming part of an exterior spreader system utilizing threaded end ties for coupling with forms for concrete, the spreader system permitting adjustment of the concrete forms in both lateral directions and for a selected series of predetermined different wall thicknesses, the plate-washer assembly including a plate and a slideable member connected with the plate, the plate having means for connecting the assembly to the walers of the forms, the slideable member having a hole having a portion large enough to permit the associated tie rod and one of said circumferential shoulders of said nut means to project therethrough and another portion of reduced dimension to engage with a portion of said one of said shoulder to releasably lock the assembly thereto, the plate having a hole aligned with the hole of the slideable member for permitting the associated tie rod to project therethrough, the slideable member adapted to be shifted linearly from a first disengaged position at which the slideable member and consequently the plate-washer assembly and forms are free of said nut means to a second locked position at which the slideable member and consequently the plate-washer assembly and forms are locked to the nut means of the exterior spreader system.

5. The invention in accordance with claim 4, wherein a waler holder is coupled with the assembly for connecting walers to the forms.

* * * * *